United States Patent [19]

Clark

[11] 4,294,447

[45] Oct. 13, 1981

[54] AERIAL AMUSEMENT PROJECTILE AND METHOD OF MANUFACTURE

[76] Inventor: Merlin W. Clark, Rte. 1, Box 171, Spanish Fork, Utah 84660

[21] Appl. No.: 74,222

[22] Filed: Sep. 10, 1979

Related U.S. Application Data

[63] Continuation-in-part of Ser. No. 19,050, Mar. 9, 1979, abandoned.

[51] Int. Cl.[3] ..... A63B 43/00

[52] U.S. Cl. ..... 273/58 R; 273/428; 15/190; 15/195; 411/457

[58] Field of Search ..... 273/428, 417, 419, 420, 273/423

[56] References Cited

U.S. PATENT DOCUMENTS

| | | | |
|---|---|---|---|
| 62,460 | 2/1867 | Wilkins et al. | 15/190 |
| 1,345,650 | 7/1920 | Wessels | 85/49 |
| 1,436,028 | 11/1922 | Flemming | 273/58 A X |
| 2,110,734 | 3/1938 | Leslie | 85/49 |
| 2,484,475 | 10/1949 | Studer | 273/417 |
| 2,796,622 | 6/1957 | Kalinowski | 15/190 X |
| 3,003,155 | 10/1961 | Mielzynski et al. | 273/420 X |
| 3,425,084 | 2/1969 | St. Laurence et al. | 15/195 |
| 3,468,821 | 9/1969 | Behrendsen | 273/58 J X |
| 4,088,319 | 5/1978 | Clarke | 273/58 K X |
| 4,133,533 | 1/1979 | Doyle | 273/417 |

FOREIGN PATENT DOCUMENTS

| | | | |
|---|---|---|---|
| 820557 | 11/1951 | Fed. Rep. of Germany | 273/428 |
| 1443833 | 5/1966 | France | 273/428 |

*Primary Examiner*—Paul E. Shapiro
*Attorney, Agent, or Firm*—H. Ross Workman; J. Winslow Young; Allen R. Jensen

[57] ABSTRACT

An aerial amusement projectile and method of manufacture, the projectile including an aerodynamic body having a streamer secured therein. The aerodynamic body is fabricated from a resilient, penetrable material and has an ornamental design on a leading face opposite the streamer. The streamer is fabricated from a plurality of multicolor ribbons and is secured inside the aerodynamic body by a novel fastener apparatus and method. The fastener may be fabricated as a U-shaped staple from a resilient wire with a pair of barbed probes or as a harpoon-like device to hold the streamer in the body. The configuration of the fastener and resiliency of the aerodynamic body material assists in securing the fastener against dislodgment from the body material. A padding member is mounted on the staple fastener to protect the streamer against abrasion. The harpoon-like fastener includes a coaxial, countersunk bore for receipt of an insertion tool.

15 Claims, 8 Drawing Figures

AERIAL AMUSEMENT PROJECTILE AND METHOD OF MANUFACTURE

RELATED APPLICATIONS

This application is a continuation-in-part application of my copending application Ser. No. 019,050 filed Mar. 9, 1979, now abandoned.

BACKGROUND

1. Field of the Invention

This invention relates to an amusement device and, more particularly, to an aerial amusement projectile and method of manufacture, the aerial amusement projectile including an aerodynamic body with a streamer secured to the body by a novel fastener apparatus and method.

2. The Prior Art

Numerous aerial amusement devices are well-known in the art and include such familiar items as balls used in sporting events such as football, basketball, baseball, soccer, tennis, and the like. Additional non-ball aerial projectiles include the conventional shuttlecock and the flying saucer-type toy sold under the tradename of Frisbee (a trademark of the Whammo Corporation).

Other aerial amusement projectiles are disclosed in U.S. Pat. Nos. 159,354; 645,919; 1,081,037; 1,436,028; 1,538,640; 2,360,173; 2,481,522; 2,484,475; 3,264,776; 3,368,815; and 3,393,911 and French Pat. No. 1,443,833 and German Pat. No. 820,557. Each of the foregoing references discloses an aerial amusement projectile with most including some form of flight stabilizing streamer. These are believed to be relatively expensive to fabricate in view of the numerous components involved and the plurality of manufacturing steps believed necessary to fabricate the same.

In view of the foregoing, it would be an advancement in the art to provide an aerial amusement projectile and method of manufacture which (1) readily adapts a commercially available sponge rubber ball as the aerodynamic body to which a streamer may be fastened; (2) a streamer for the projectile, the streamer being fabricated from a plurality of multicolor strips, some of the strips selectively being fabricated from a plastic material having a shiny metallic surface; and (3) a fastener for the streamer and adapted to be embedded in the material of the body and being fabricated as a harpoon-like body either from a resilient wire including barbed probes formed therein with the resiliency of the wire forcing the barbs outwardly into engagement with the sponge material of the aerodynamic body or as a solid body also adapted to be embedded within the resilient material of the aerodynamic body. Such an invention is disclosed and claimed herein.

BRIEF SUMMARY AND OBJECTS OF THE INVENTION

The present invention relates to a novel aerial amusement projectile and method of manufacture whereby a commercially available, synthetic sponge body such as a spherical ball or other selected shape has a multicolor, multi-strand streamer secured thereto. Securement of the streamer is easily accomplished by engaging the streamer with a fastener and embedding the fastener in the sponge material of the aerodynamic body. The fastener may be fabricated as a harpoon-like body either from a resilient wire with barbs formed therein so that the resiliency of the wire forces the barbed probes outwardly into engagement with the sponge material or as a solid body for embedment in and engagement by the resiliency of the sponge-like material of the aerodynamic body.

It is, therefore, a primary object of this invention to provide improvements in aerial projectiles.

Another object of this invention is to provide an improved method for manufacturing an aerial amusement projectile.

Another object of this invention is to provide an amusement projectile having a novel visual appearance.

Another object of this invention is to provide an improved fastener whereby the streamer may be replaced or re-attached to the aerial projectile.

Another object of this invention is to provide improvements in fastening a streamer to an aerodynamic body.

These and other objects and features of the present invention will become more fully apparent from the following description and appended claims taken in conjunction with the accompanying drawing.

DETAILED DESCRIPTION OF THE PREFERRED EMBODIMENTS

Figure 1:
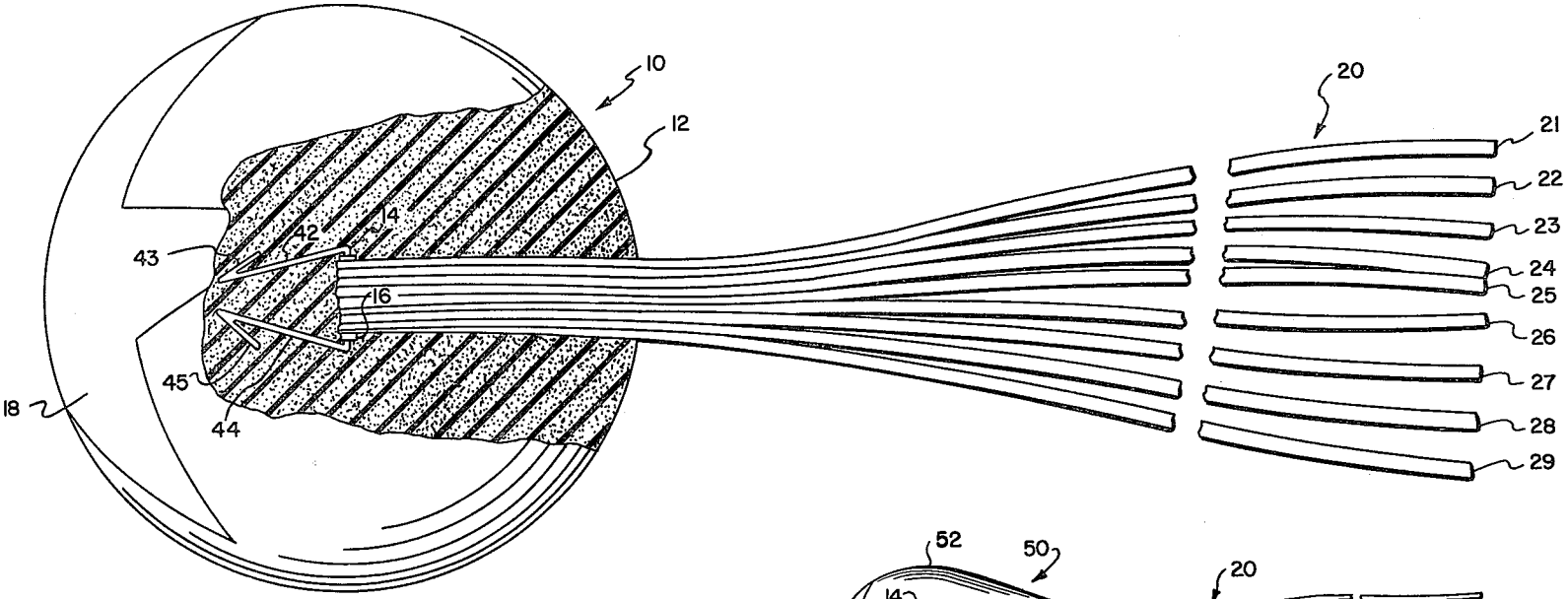
FIG. 1 is a plan view of a first preferred embodiment of the aerial amusement projectile of this invention with portions broken away to reveal internal features.

The invention is best understood by reference to the drawing wherein like parts are designated with like numerals throughout.

Referring now more particularly to FIG. 1, a first preferred embodiment of the aerial amusement projectile of this invention is shown generally at 10 and includes an aerodynamic body 12 to which a streamer 20 is affixed by a fastener 14. Aerodynamic body 12 is fabricated from a suitable, resilient and penetrable material such as rubber, synthetic sponge or the like. Advantageously, aerodynamic body 12 can be prepared from a commercially available sponge rubber ball.

Aerodynamic body 12 is suitably embossed with an ornamental design shown herein as star design 18. Star design 18 is formed on a leading face of aerodynamic body 12, the leading face being opposite the exit site of streamer 20 from aerodynamic body 12. Streamer 20 serves as a drogue for aerodynamic body 12 during flight thereby presenting star design 18 at the forward profile of aerial amusement projectile 10. Star design 18 may be either painted or otherwise printed directly on the face of aerodynamic body 12 or may be separately fabricated from a sheet of aluminized Mylar, for example, and adhesively secured to aerodynamic body 12. The remainder of the surface of aerodynamic body 12 not covered by star design 18 may be any suitable color which contrasts or compliments the color of star design 18 thereby providing a pleasing visual appearance to aerodynamic body 12.

Streamer 20 is fabricated from a plurality of ribbons 21–29 (shown broken and thereby substantially foreshortened for ease of illustration). Ribbons 21–29 may be prepared by cutting strips from an aluminized Mylar material, fabric, or other suitable plastic material. Preferably, the material of ribbons 21–29 is multicolor and, advantageously, includes shiny, metallic surfaces for imparting a pleasing visual appearance to aerial amusement projectile 10 while in flight. Importantly, ribbons 21–29 are fabricated from a suitably flexible material so as to impart a shimmering or fluttering appearance to streamer 20 during flight of aerial amusement projectile 10.

Additionally, streamer 20 is prepared from a material having sufficient strength to withstand forces imposed thereon when streamer 20 is used as a tether for twirling aerodynamic body 12 prior to launching the same upon release of streamer 20 by the thrower (not shown). Streamer 20 thereby serves as a throwing handle with streamer 20 being hand-grasped to accommodate the thrower (not shown) twirling aerodynamic body 12 in a circle for an increased impetus upon launch. The increased centrifugal force imparted to aerodynamic body 12 assures a longer flight distance thereby greatly enhancing the play characteristics of aerial amusement projectile 10. Importantly, in view of the stresses imposed upon streamer 20 and its interconnection with aerodynamic body 12, streamer 20 is securely fastened to aerodynamic body 12 by the particular fastener.

Figure 3:
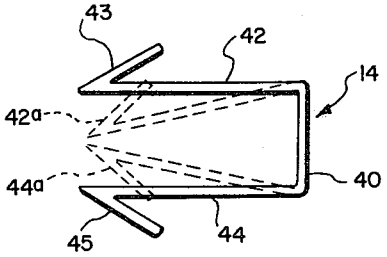
FIG. 3 is a plan view of the fastener of FIGS. 1 and 2 with an intermediate configuration indicated in broken lines.

Referring now more particularly to FIG. 3, fastener 14 is shown configurated as a U-shaped keeper having a generally rectangular profile. Fastener 14 consists of a centrally disposed, streamer-engaging midsegment or base member 40 with probes 42 and 44 extending from each end. Probes 42 and 44 are coplanar and generally perpendicular to base member 40. Probes 42 and 44 have barbs 43 and 45, respectively, formed on the ends thereof. Barbs 43 and 45 are also coplanar and directed outwardly with respect to the remainder of fastener 14.

Advantageously, fastener 14 is fabricated from a suitably resilient wire material so that probes 42 and 44 are urged inwardly to the position indicated by broken lines **42*a* and 44*a*, respectively, thereby readily adapting fastener 14 for penetration into aerodynamic body 12. Fastener 14 is inserted into aerodynamic body 12 preferably to a position beyond the epicenter of aerodynamic body 12 thereby providing a more secure lodgement of streamer 20 thereto. After penetration, barbs 43 and 45 are urged outwardly by the resilient characteristics of fastener 14 thereby forcing barbs 43 and 45 into more secure engagement with the material of aerodynamic body 12. Additionally, forces against streamer 20 tending to dislodge fastener 14 cause barbs 43 and 45 to be urged outwardly into more secure engagement with the resilient material of aerodynamic body 12. In this manner, fastener 14 is securely embedded within aerodynamic body 12 thereby resisting dislodgment therefrom by pulling forces against streamer 20**.

Figure 4:
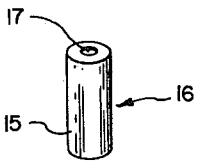
FIG. 4 is a perspective view of the padding member of FIGS. 1 and 2.

With particular reference to FIG. 4, a padding member 16 is shown and consists of a generally cylindrical padding body 15 having an axial bore 17 therethrough. Axial bore 17 is configurated to be slipped over base member 40 during manufacture of fastener 14 prior to probes 42 and 44 being formed therein. Alternatively, a longitudinal slit (not shown) may be cut into padding member 16 between the external surface and bore 17 to accommodate padding member 16 being slipped over base member 40 after fastener 14 has been fabricated.

Padding member 16 is provided for the purpose of cushioning or otherwise protecting individual ribbons 21–29 of streamer 20 (FIG. 1) against abrasion or cutting by contact with the relatively small diameter wire of base member 40 of fastener 14 (FIG. 3). Padding member 16 is fabricated from a suitable, resilient material to provide a resilient, enlarged diameter surface against which streamer 20 may be held inside aerodynamic body 12 thereby reducing inadvertent dislodgment of streamer 20 from aerodynamic body 12.

Fastener 14 is adapted to be securely embedded within the structural material of aerodynamic body 12 thereby precluding inadvertent dislodgment of streamer 20 from aerodynamic body 12.

Fastener 14 is adapted to be securely embedded within the structural material of aerodynamic body 12 thereby precluding inadvertent dislodgment or removal. A padding member 16 is mounted on fastener 14 for (1) cushioning ribbons 21–29 against abrasion by fastener 14 and (2) clamping ribbons 21–29 between padding member 16 and the material of aerodynamic body 12. The illustrated, broken away portion of aerodynamic body 12 shown in FIG. 1 provides a more clear understanding of the interrelationship of the various components and the fastening technique for aerodynamic body 12, fastener 14, padding member 16, and streamer 20.

Figure 2:
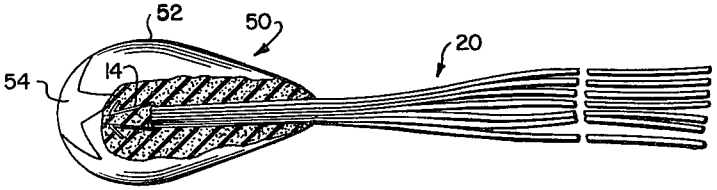
FIG. 2 is a plan view of a second preferred embodiment of the aerial amusement projectile of this invention with portions broken away to reveal internal features.

Referring now more particularly to FIG. 2, a second preferred embodiment of the aerial amusement projectile of this invention is shown herein at 50 and includes an aerodynamic body 52 with a streamer 20 secured thereto. Aerodynamic body 52 is fabricated with a teardrop-like configuration with a streamer 20 extending from the apex of the teardrop profile. Fastener 14 is embedded inside aerodynamic body 52 and thereby provides a secure anchor for streamer 20. Aerodynamic body 52 also includes an ornamental star design 54 embossed on a leading face. Streamer 20 acts as a drogue member to stabilize the direction of flight of aerodynamic body 52 thereby presenting the star design 54 at the forward end of aerial amusement projectile 50. It should be emphasized that the broken away portion of aerodynamic body 52 illustrates the interrelationship among aerodynamic body 52, streamer 20 and fastener 14. Clearly, in practice, streamer 20 will be securely clamped to aerodynamic body 52 by fastener 14 and padding member 16 (FIG. 4) as set forth hereinbefore with respect to the embodiment shown in FIG. 1.

Figure 5:
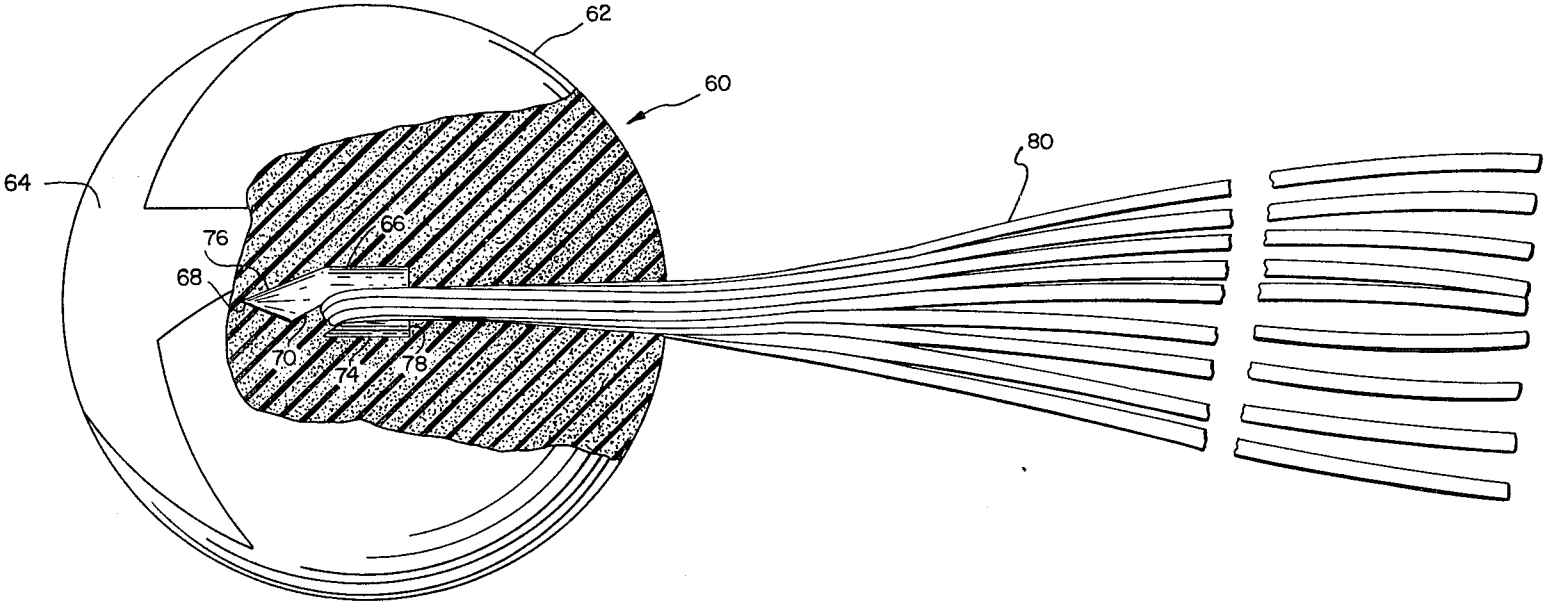
FIG. 5 is a plan view of a third preferred embodiment of the aerial amusement projectile of this invention with portions broken away to reveal internal features.

Referring now more particularly to FIG. 5, a third preferred embodiment of the aerial amusement projectile of this invention is shown generally at 60 and includes an aerodynamic body 62 to which a streamer 80 is attached by a harpoon-like fastener 66. Aerodynamic body 62, like aerodynamic bodies 12 and 52 (FIGS. 1 and 2, respectively), is fabricated from a suitable, resilient and penetrable material such as a rubber, synthetic sponge material or the like. Advantageously, aerodynamic body 62 can be prepared from a commercially available sponge rubber ball.

Aerodynamic body 62 is suitably embossed with an ornamental design shown herein as a star design 64. Star design 64 is formed on the leading face of aerodynamic body 62, the leading face being opposite the exit site of streamer 80 from aerodynamic body 62. Streamer 80 serves as a drogue for aerodynamic body 62 during flight, thereby presenting star design 64 at the forward profile of aerial amusement projectile 60. Star design 64 may be either painted or otherwise printed directly on the face of aerodynamic body 62 or may be separately fabricated from a sheet of aluminized Mylar and adhesively secured to aerodynamic body 62. The remainder of the surface of aerodynamic body 62 not covered by star design 64 may be any suitable color which contrasts or compliments the color of star design 64 thereby providing a pleasing visual appearance to aerodynamic body 62.

Streamer 80 is fabricated from a plurality of discrete ribbons (shown broken and thereby substantially foreshortened for ease of illustration). Streamer 80 may be fabricated by cutting a plurality of strips from an aluminized Mylar material, fabric, or other suitable material. Preferably, the material of streamer 80 is multi-color and, advantageously, includes shiny, metallic surfaces for imparting a pleasing visual appearance to aerial amusement projectile 60 while in flight. Importantly, streamer 80 is fabricated from a suitably flexible material so as to impart the shimmering or fluttering appearance to streamer 80 during flight of aerial amusement projectile 60. Additionally, streamer 80 is prepared from a material having sufficient strength to withstand forces imposed thereon when streamer 80 is used as a tether for twirling aerodynamic body 62 prior to launching the same upon release of streamer 80 by the thrower (not shown). Streamer 80 thereby serves as a throwing handle with streamer 80 being hand-grasped to accommodate the thrower (not shown) twirling aerodynamic body 62 in a circle for an increased impetus upon launch. The increased centrifugal force imparted to aerodynamic body 62 assures a longer flight distance thereby greatly enhancing the play characteristics of aerial amusement projectile 60. Importantly, in view of the stresses imposed upon streamer 80 and its interconnection with aerodynamic body 62, streamer 80 is securely fastened to aerodynamic body 62 by the second preferred fastener embodiment, fastener 66.

Figure 6:
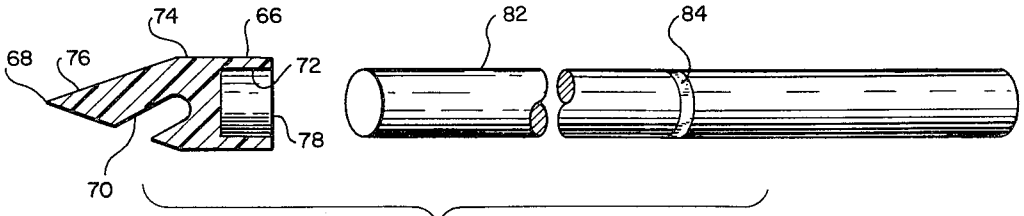
FIG. 6 is a cross-sectional view of the fastener of FIG. 5 and shown in an exploded relationship with an insertion rod for the fastener.

With reference also to FIG. 6, fastener 66 is fabricated as a cylindrical body 74 having a cone 76 extending from one end thereof and terminating in an apex 68. A slot 70 is cut in one face of cone 76 and provides a securement device for streamer 80 engaged by fastener 66. Fastener 66 is particularly configurated with a harpoon-like configuration to accommodate being penetrably inserted into aerodynamic body 62 with the cone 76 spreading or otherwise momentarily displacing the resilient material of aerodynamic body 62 to allow the passage of fastener 66 into aerodynamic body 62. After insertion of fastener 66, the resilient material of aerodynamic body 62 tends to return to its original position thereby closing around streamer 80 and forming a surface against which a base 78 presses thereby resisting dislodgment of fastener 66 when tensile forces are imposed upon streamer 80. Additionally, the resilience of the material of aerodynamic body 62 encloses about the portion of embedded streamer 80 within aerodynamic body 62 providing additional frictional engagement between aerodynamic body 62 and streamer 80.

Referring now more particularly to FIG. 6, fastener 66 is shown in cross-section and in exploded relationship with an insertion rod 82. In particular, a coaxial counterbore 72 is formed in base 78 and is fabricated to receive the end of insertion rod 82 in snug-fitting relationship. While rod 82 does not form a part of the apparatus of this invention, rod 82 substantially facilitates the fabrication of the aerial amusement projectile 60 (FIG. 5) of this invention. In particular, the end of rod 82 is inserted into counterbore 72 and streamer 80 is engaged by slot 70. Thereafter, apex 68 is placed against the surface of aerodynamic body 62 (FIG. 5) and pushed by means of insertion rod 82 and forced inside aerodynamic body 62 along a diameter thereof until reaching a point inside aerodynamic body 62 preferably beyond the epicenter of aerodynamic body 62. Advantageously, counterbore 72 receives the end of insertion rod 82 in snug-fitting, releasable relationship so that the direction of insertion of fastener 66 can be suitably controlled thereby precluding misalignment of fastener 66 during insertion. An indicia 84 may be included on insertion rod 82 to serve as a marker for the operator (not shown) to assist in placing fastener 66 at the appropriate location within aerodynamic body 62 by allowing the operator to visually observe when indicia 84 reaches the external surface of aerodynamic body 62 during insertion of fastener 66. Thereafter, the insertion rod 82 is readily removed from aerodynamic body 62 leaving fastener 66 with streamer 80 securely attached to aerodynamic body 62 thereby completing assembly of aerial projectile 60. Insertion rod 82 may then be used for assembling the next aerial amusement projectile 60.

Figure 8:
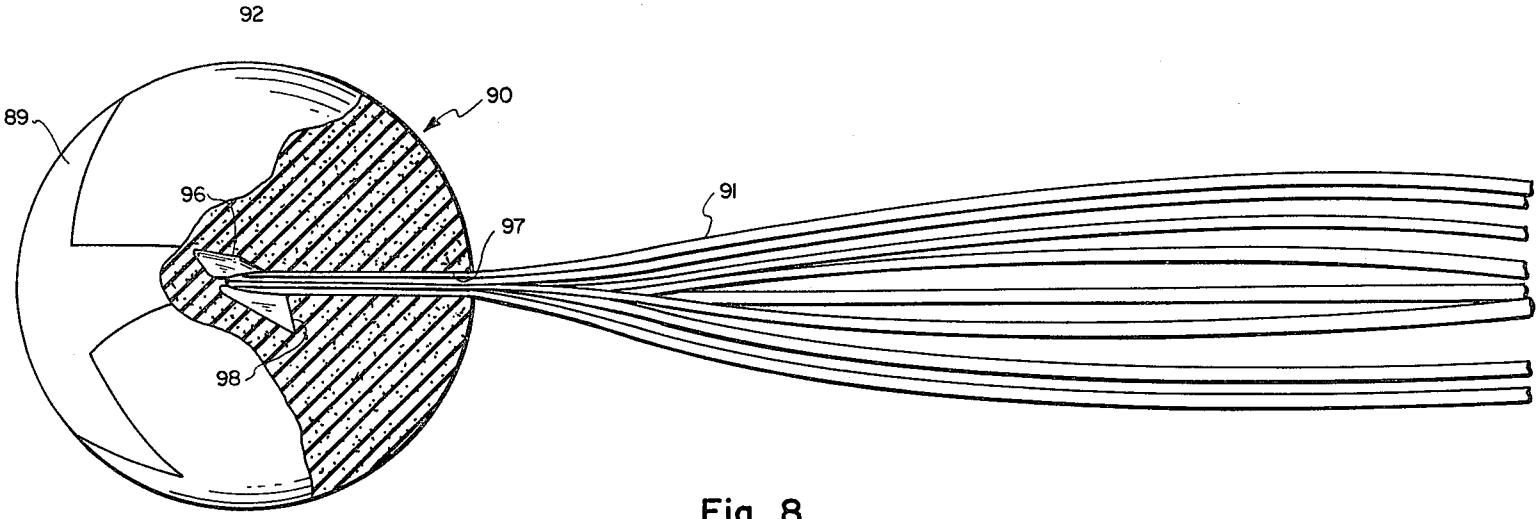
FIG. 8 is a plan view of another preferred embodiment of the aerial projectile of this invention with portions broken away to reveal the fastener of FIG. 7 embedded therein.
Figure 7:
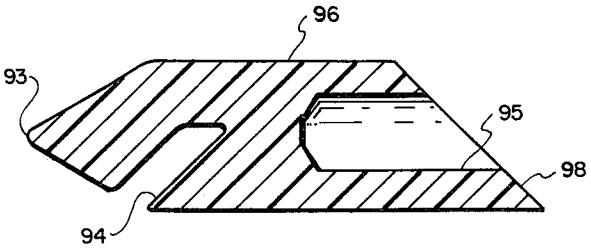
FIG. 7 is an enlarged, cross-sectional view of another preferred embodiment of a fastener.

Referring now to FIGS. 7 and 8, another preferred embodiment of the aerial amusement projectile of this invention is shown generally at 90 (FIG. 8) and includes a streamer 91 secured to an aerodynamic body 92 by a harpoon-like fastener 96. Aerodynamic body 92, like aerodynamic bodies 12 (FIG. 1), 52 (FIG. 2), and 62 (FIG. 5), is fabricated from a suitable, resilient and penetrable material such as a rubber, synthetic sponge material or the like. Advantageously, aerodynamic body 92 can be readily prepared from a commercially available sponge rubber ball.

As in the other preferred embodiments of this invention, aerodynamic body 92 is suitably embossed or otherwise decorated with an ornamental design shown herein as a star design 89. Star design 89 is formed on the leading face of aerodynamic body 92, which is the face opposite the face from which streamer 91 extends from aerodynamic body 92. Streamer 91 serves as a drogue for aerodynamic body 92 during flight so that star design 89 is at the leading profile of aerial amusement projectile 90. Star design 89 may be formed on aerodynamic body 92 by any suitable means such as painting, printing, or adhesive securement of a separate design, for example, a star cut from a sheet of aluminized Mylar and adhesively secured at the desired location on aerodynamic body 92. The remainder of the surface of aerodynamic body 92 may be of any suitable color which either contrasts or compliments the color and appearance of star design 89 thereby providing a pleasing visual appearance to aerodynamic body 92.

Streamer 91 is preferentially fabricated from a plurality of discrete ribbons which may be prepared, for example, by cutting a plurality of strips from an aluminized Mylar material or any other suitable material.

Preferably, the material of streamer 91 is multi-colored and, advantageously, includes a plurality of shiny, metallic surfaces for imparting a pleasing visual appearance to streamer 91 while aerial amusement projectile 90 is in flight. Streamer 91 is also fabricated from a suitably flexible material so that streamer 91 imparts a desirable shimmering or fluttering appearance during flight. Additionally, streamer 91 is fabricated from a material having sufficient strength to withstand the forces imposed thereon when streamer 91 is used as a tether for twirling aerodynamic body 92 prior to launching the same upon release of streamer 91 by the thrower (not shown). Streamer 91 thereby readily serves as a throwing handle for the thrower (not shown) hand-grasping the same to accommodate twirling aerodynamic body 92 in a circle for an increased impetus upon launch. The increased centrifugal forces imposed upon aerodynamic body 92 assures a longer flight distance of aerial amusement projectile 90 thereby greatly enhancing the play characteristics of the same.

Importantly, in view of the stresses imposed upon streamer 91 and its interconnection with aerodynamic body 92, fastener 96 is selectively configurated to provide a secure engagement inside aerodynamic body 92. Fastener 96 is fabricated as a cylindrical body having an apex 93, a streamer-receiving slot 94, a coaxial counterbore 95, and a slanted rear face 98. Counterbore 95 selectively receives an insertion rod similar to insertion rod 82 (FIG. 6) while apex 93 allows fastener 96 to be penetrably inserted inside aerodynamic body 92. For example, during assembly of aerial amusement projectile 90, a plurality of suitable ribbons forming streamer 91 are folded into slot 94 and an insertion rod is inserted into counterbore 95. Fastener 96 is inserted inside aerodynamic body 92 and the insertion rod (not shown) is thereafter removed, leaving fastener 96 with streamer 91 attached thereto embedded within aerodynamic body 92. Tensile forces exerted on streamer 91 cause fastener 96 to pivot longitudinally so that the angular profile of face 98 cuts into the material of aerodynamic body 92 in an offset configuration shown best in FIG. 8 thereby more securely lodging fastener 96 within aerodynamic body 92. The configuration of fastener 96 is, therefore, such that fastener 96 is securely embedded within aerodynamic body 92 to strongly resist any attempt toward dislodgment thereof. Accordingly, it can readily be seen that while fastener 96 is inserted through a relatively small passageway represented by passageway 97, the cross-sectional area against which fastener 96 is in frictional engagement with the material of aerodynamic body 92 is greatly enlarged so that fastener 96 is securely engaged within aerodynamic body 92.

The invention may be embodied in other specific forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An aerial amusement projectile comprising:

an aerodynamic body fabricated from a penetrable, resilient material, the aerodynamic body having an aerodynamic profile;

a streamer fabricated from a plurality of ribbons; and a fastener for securing the streamer to the aerodynamic body, the fastener comprising:

a harpoon body;

a streamer engaging means on the harpoon body, the streamer-engaging means accomodating securement of the streamer to the aerodynamic body upon the harpoon body being inserted inside the aerodynamic body with the harpoon body being held against dislodgment by the resilient material of the aerodynamic body; and a counterbore in the harpoon body, the counterbore serving as an insertion rod receiving means.

2. The aerial amusement projectile defined in claim 1 wherein the aerodynamic body is configurated as a solid sphere.

3. The aerial amusement projectile defined in claim 1 wherein the body is fabricated from a synthetic sponge material.

4. The aerial amusement projectile defined in claim 1 wherein the aerodynamic body is solid and is configurated with a teardrop shape, the streamers being secured to the apex of the teardrop shape.

5. The aerial amusement projectile defined in claim 1 wherein the aerodynamic body is decorated with a star design on a face opposite from where the streamers are secured to the body.

6. The aerial amusement projectile defined in claim 1 wherein the ribbons are fabricated from strips of flexible plastic material, the plastic material having a shiny, metallic-like finish on at least one side.

7. An aerial amusement projectile comprising:

an aerodynamic body fabricated from a penetrable, resilient material, the aerodynamic body having an aerodynamic profile;

a streamer fabricated from a plurality of ribbons; and a fastener for securing the streamer to the aerodynamic body, the fastener comprising a harpoon member, the harpoon member comprising a cylindrical segment with a conical surface terminating in an apex on a first end, a streamer engagement means, and a base on the second end, the apex accommodating penetration of the resilient material of the aerodynamic body and the streamer engagement means providing securement of the streamer to the aerodynamic body by being inserted inside the aerodynamic body with the harpoon member being held against dislodgment by the resilient material of the aerodynamic body, said streamer engagement means comprising a notch in a face of the harpoon member.

8. An aerial amusement projectile comprising:

an aerodynamic body fabricated from a penetrable, resilient material, the aerodynamic body having an aerodynamic profile;

a streamer fabricated from a plurality of ribbons; and a fastener for securing the streamer to the aerodynamic body, the fastener comprising a harpoon member, the harpoon member comprising a cylindrical segment with a conical surface terminating in an apex on a first end, a streamer engagement means, and a base on the second end, the apex accommodating penetration of the resilient material of the aerodynamic body and the streamer engagement means providing securement of the streamer to the aerodynamic body by being inserted inside the aerodynamic body with the harpoon member being held against dislodgment by the resilient material of the aerodynamic body, the harpoon member comprising a coaxial counterbore in the base, the counterbore serving as an insertion rod receiver means.

9. An aerial amusement projectile comprising:

an aerodynamic body fabricated as a solid shape from a penetrable, resilient, sponge material;

a streamer comprising a plurality of ribbons, the ribbons being fabricated from a flexible material; and a fastener for securing the streamer to the aerodynamic body, the fastener being fabricated as a harpoon member having a penetrating means and a streamer engaging means to accommodate being inserted inside the aerodynamic body to thereby secure an end of the streamer inside the aerodynamic body, the harpoon member comprising a body having a base at one end and an apex at the other end, the fastener comprising an angular face on the base and a leading edge defined by the perimeter of the angular face, the angular face being positioned at the end of the fastener nearest the point of insertion on the aerodynamic body after the fastener has been inserted into the aerodynamic body, the angular face comprising a planar element forming an angle of less than 90° with the axis of the harpoon member so that pulling forces against said harpoon member cause the leading edge of said planar element to cut into said sponge material thereby accommodating the base causing the leading edge of the fastener to cut into the sponge material and thereby twist the harpoon member longitudinally under pulling forces exerted on the streamer, the apex allowing the body to be forceably inserted inside the aerodynamic body while the base inhibits dislodgment of the harpoon member from the aerodynamic body.

10. An aerial amusement projectile comprising:

an aerodynamic body fabricated from a penetrable, resilient material, the aerodynamic body having an aerodynamic profile;

a streamer fabricated from a plurality of ribbons; and a fastener for securing the streamer to the aerodynamic body, the fastener comprising a keeper, the keeper comprising:

a base;

a streamer-engaging means; and a leading edge, the fastener accommodating securement of the streamer to the aerodynamic body by being inserted inside the aerodynamic body with the keeper being held against dislodgment by the resilient material of the aerodynamic body, the base comprising an angular face to accommodate enhanced securement between the keeper and the aerodynamic body, the leading edge being defined by the perimeter of the angular face, the angular face being positioned at the end of the keeper nearest the point of insertion on the aerodynamic body after the fastener has been inserted into the aerodynamic body, the angular face of the base comprising a planar element forming an angle of less than 90° with the axis of the keeper so that forces pulling against said streamer tend to cause said leading edge of said angular face to cut into said resilient material and pivot said keeper inside said aerodynamic body.

11. A method for manufacturing an aerial amusement projectile comprising:

preparing an aerodynamic body from a solid mass of synthetic sponge material, the synthetic sponge material being resilient and penetrable, the body having a suitable aerodynamic profile;

obtaining a plurality of ribbons by cutting a flexible sheet material into a plurality of strips and bundling the strips into a streamer;

fabricating a fastener for the streamer by forming the fastener as a harpoon member having a base and a penetrating means extending from the end opposite the base and having a streamer engaging means, the fabricating step further comprising forming the harpoon member with an apex at one end and a basal portion at the other end with the streamer engaging means therebetween, the apex accomodating inserting the harpoon member into the aerodynamic body and the basal portion inhibiting dislodgment of the harpoon member from the aerodynamic body, the forming step further comprising preparing a coaxial counterbore in the basal portion, the counterbore removably receiving an insertion rod to facilitate inserting the fastener into the aerodynamic body; and mounting the streamer to the aerodynamic body by securing the streamer with the streamer engaging means of the fastener and inserting the fastener into the aerodynamic body so that the fastener is completely inside the aerodynamic body with the streamer extending from the aerodynamic body, the resilient material of the aerodynamic body resisting dislodgment of the fastener and the streamer from the body.

12. The method defined in claim 11 wherein the preparing step further comprises obtaining an insertion rod and placing an indicia on the insertion rod at a predetermined location, the indicia serving as a guide means for inserting the fastener at a predetermined position inside the aerodynamic body.

13. The method defined in claim 11 wherein the preparing step further comprises decorating the aerodynamic body with a star insignia on a face opposite the streamer.

14. A method for manufacturing an aerial amusement projectile comprising:

preparing an aerodynamic body from a solid mass of synthetic sponge material, the synthetic sponge material being resilient and penetrable, the body having a suitable aerodynamic profile;

obtaining a plurality of ribbons by cutting a flexible sheet material into a plurality of strips and bundling the strips into a streamer;

fabricating a fastener for the streamer by forming the fastener as a harpoon member having a base and a penetrating means extending from the end opposite the base and having a streamer engaging means, the base having a counterbore formed therein to serve as an insertion rod receiving means;

forming a slanted face on the base of the harpoon member, the slanted face being formed as a planar element angularly offset from an axis of insertion of said harpoon member into said sponge material so that pulling forces against said streamer tend to cause a leading edge of said planar element to cut into said sponge material thereby accommodating the harpoon member being longitudinally offset upon rearward movement of the harpoon member in the aerodynamic body;

mounting the streamer to the aerodynamic body by securing the streamer with the streamer engaging means of the fastener and by placing an insertion rod into the counterbore and inserting the insertion rod and fastener into the aerodynamic body so that the fastener is completely inside the aerodynamic body with the streamer extending from the aerodynamic body, the resilient material of the aerodynamic body resisting dislodgment of the fastener and the streamer from the body; and rotating the fastener inside the aerodynamic body by pulling on the streamer and causing the base to cut into the resilient material of the aerodynamic body so as to provide better securement of the fastener thereto.

15. A method for manufacturing an aerial amusement projectile comprising:

preparing an aerodynamic body from a solid mass of synthetic sponge material, the synthetic sponge material being resilient and penetrable, the body having a suitable aerodynamic profile;

obtaining a plurality of ribbons by cutting a flexible sheet material into a plurality of strips and bundling the strips into a streamer;

fabricating a fastener for the streamer by forming the fastener as a harpoon member having a base and a penetrating means extending from the end opposite the base and having a notch in a face of the harpoon member, the notch serving as a streamer engaging means, the base having a counterbore formed therein to serve as an insertion rod receiving means;

mounting the streamer to the aerodynamic body by securing the streamer in the notch of the streamer engaging means of the fastener and by placing an insertion rod into the counterbore and inserting the insertion rod and fastener into the aerodynamic body so that the fastener is completely inside the aerodynamic body with the streamer extending from the aerodynamic body, the resilient material of the aerodynamic body resisting dislodgment of the fastener and the streamer from the body; and rotating the fastener inside the aerodynamic body by pulling on the streamer and causing the base to cut into the resilient material of the aerodynamic body so as to provide better securement of the fastener thereto.

* * * * *